United States Patent [19]

Wu

[11] Patent Number: 4,924,550

[45] Date of Patent: May 15, 1990

[54] TRI-SHAFT TYPE MULTI-FUNCTION CLEANER

[76] Inventor: Dong Her Wu, 141, Chang Shui Road, Sec. 2, Pu Yen Hsiang, Changhua, Taiwan

[21] Appl. No.: 259,718

[22] Filed: Oct. 19, 1988

[51] Int. Cl.[5] ..... A46B 13/04; A47L 5/00

[52] U.S. Cl. ..... 15/328; 15/4; 15/29; 15/97 R; 15/344

[58] Field of Search ..... 15/28, 29, 97 R, 4, 15/344, 328; 51/170 T, 181 R

[56] References Cited

U.S. PATENT DOCUMENTS

| | | | |
|---|---|---|---|
| 3,638,264 | 2/1972 | Walton | 15/29 |
| 4,137,588 | 2/1979 | Sandt et al. | 15/28 |
| 4,299,004 | 11/1981 | Lancaster | 15/28 |
| 4,574,419 | 3/1986 | Lex | 15/328 |
| 4,799,280 | 1/1989 | Lee | 15/29 |

FOREIGN PATENT DOCUMENTS

| | | | |
|---|---|---|---|
| 596035 | 7/1959 | Italy | 15/28 |

*Primary Examiner*—Edward L. Roberts

*Attorney, Agent, or Firm*—Bacon & Thomas

[57] ABSTRACT

A multi-function cleaner provided with three rotating shafts that are connectable with a scrubbing brush, a floor wax polisher and an air extractor vane wheel to permit the cleaner to perform the functions of scrubbing, polishing and dust extraction. The shafts are driven by a motor through a gearing arrangement to rotate the shafts at different speeds. The shaft connectable to the scrubbing brush includes a water outlet which receives water from an inlet forming part of a handle for the cleaner and the air extractor vane wheel is carried by a detachable cover provided with an extended sucker for facilitating the dust suction operation.

5 Claims, 3 Drawing Sheets

TRI-SHAFT TYPE MULTI-FUNCTION CLEANER

BACKGROUND OF THE INVENTION

1. Field of the Invention

The present invention relates to a multi-function cleaner and, more particularly, to a cleaner which includes three shafts of different sizes for rotation at different speeds, so that the shafts may be connected to a scrubbing brush, a floor wax polisher, or an air extractor vane wheel to permit the cleaner to function in either a scrubbing, polishing or dust suction operation.

2. Description of the Prior Art

A conventional motorized cleaning device comprises only a single revolving shaft for connection with either a scrubbing brush or a floor wax polisher to perform a scrubbing or polishing operation. While in the scrubbing operation, the device requires a relatively slower shaft revolving speed to produce a stronger twisting force to urge the brush downwardly. By contrast, a floor wax polishing operation requires a higher shaft revolving speed to facilitate polishing. Thus, a conventional cleaner having a single shaft and a single revolving speed is not very practical to fully satisfy the requirements of both floor scrubbing and polishing operations. Although there is another type of known motorized cleaner which is equipped with a switch for changing the revolving speed of the shaft, this cleaner is usually provided with a plastic gear wheel which is easily worn when it is forced to change speed under high speed operation. Therefore, this latter type of motorized cleaning device is also unsatisfactory.

Moreover, conventional cleaning devices are not able to provide connection with a vacuum for dust extraction. To permit a dust extraction process, an additional vacuum cleaner is required. Thus, it is not very convenient to use several devices for performing a cleaning job.

SUMMARY OF THE INVENTION

The major object of the present invention is to provide a multi-function cleaner which includes three different revolving shafts for rotation at different speeds to drive a scrubbing brush, a floor wax polisher or an air extractor vane wheel, so as to permit scrubbing, polishing and dust suction operations.

Another object of the invention is to provide a multi-function cleaner having three shafts of different sizes for rotation at different speeds so that the shafts may be connected with a scrubbing brush, a floor wax polisher and an air extractor vane wheel in an efficient manner to permit scrubbing, polishing and dust suction functions.

Other objects, advantages and features of the invention shall become apparent from the following detailed description of a preferred embodiment thereof, when taken in conjunction with the drawings wherein like reference characters refer to corresponding parts of the several views.

DETAILED DESCRIPTION OF THE PREFERRED EMBODIMENT

Figures 1, 1A:
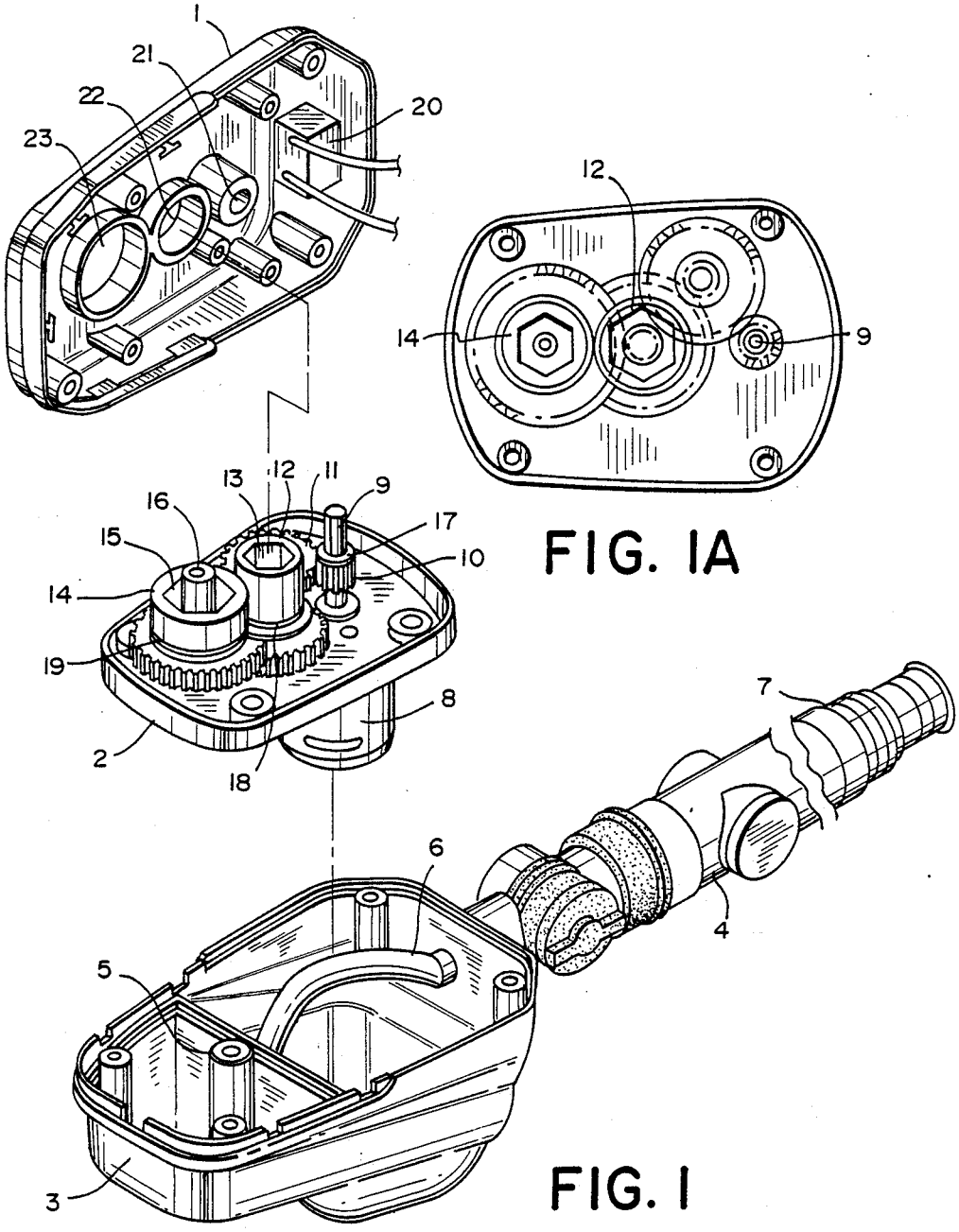
FIG. 1 is an exploded perspective and fragmentary view of a multi-function cleaner according to a preferred embodiment of the invention.
FIG. 1A is a schematic top plan view of the driving mechanism.

Referring to the perspective fragmentary view of the present invention as shown in FIG. 1, the cleaner is mainly comprised of a cover plate 1, a driving mechanism 2, a housing 3 and a handle 4. The housing 3 includes a water outlet 5 for connection with a water intake pipe 6. The water intake pipe 6 is extended to a water inlet 7 carried by the handle 4. The water inlet 7 is for connection to an outside water pipe 4 receiving water through water inlet 7 and flowing out of the water outlet 5.

As seen in the schematic view drawing of the driving mechanism shown in FIG. 1A, a motor 8 rotates a thinner hexagonal shaft 9. The hexagonal shaft 9 is provided with a coaxial gear 10 at its lower portion for engagement with a driving gear 11 to drive a bigger round shaft 12 at a relatively lower speed when the hexagonal shaft 9 is driven by the motor 8. By means of the engagement of one big gear with one pinion, the round shaft 12, which includes a hexagonal hollow socket 13, is disposed to drive another round shaft 14 having a bigger hollow socket for rotation at a relatively slower speed. The revolving shaft 14 includes a hexagonal hollow socket 15 and a conduit 16 at the center thereof. The conduit 16 is arranged to communicate with the water outlet 5 at the bottom of housing 3 to permit water from the water outlet 5 to be ejected out of the conduit 16. The three revolving shafts 9, 12, 14 are each respectively attached with an O-ring 17, 18, 19 to provide a connection seal.

Figure 2:
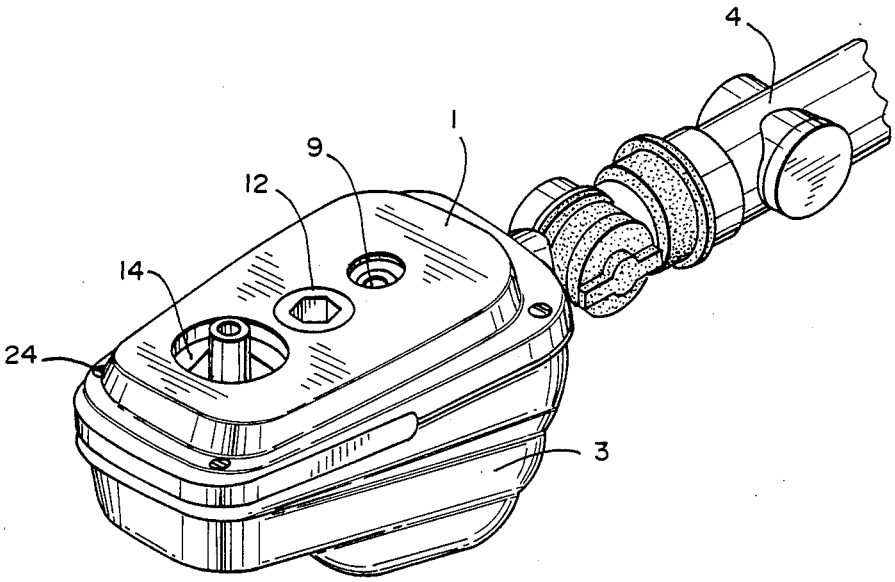
FIG. 2 is a perspective view of the assembled cleaner shown in FIG. 1.

The cover plate 1 includes a terminal box 20 having two electric wires connected to the motor 8 to provide driving power. Three holes 21, 22, 23 of different diameters are provided on the top of the cover plate 1 for receiving the corresponding shafts 9, 12, 14, respectively, when the driving mechanism 2 is secured to the bottom of the cover plate 1. The three shafts 9, 12, 14 are provided with respective O-rings 17, 18, 19 to prevent permeation of water into the inner portion of the cleaner when the driving mechanism 2 is secured to the bottom of the cover plate 1. As shown in FIG. 2, the cover plate 1 is provided with four bolt holes 24 at four corners for securing the cover plate 1 to the housing 3.

According to the present invention, the revolving shaft 9 is disposed to rotate at the highest speed, the revolving shaft 12 is disposed to rotate at the second highest speed, and the revolving shaft 14 is disposed to rotate at the lowest speed. Therefore, the revolving shaft 14 is for connection with a scrubbing brush 25 to provide maximum twisting force for facilitating a scrubbing operation. The revolving shaft 9 is for connection with an air extractor vane wheel 26 to provide maximum rotation for facilitating a dust sucking operation. The revolving shaft 12 of moderate revolving speed is for connection with a floor wax polisher 27 for facilitating a floor polishing operation.

Figure 3:
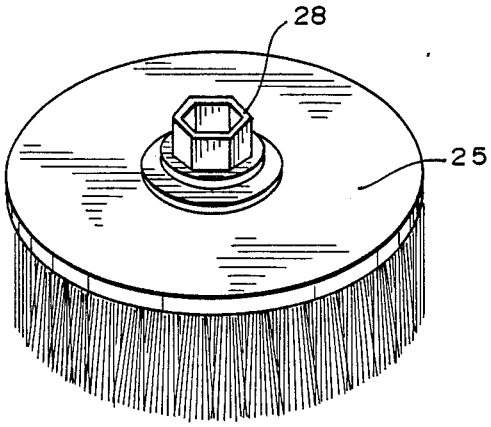
FIG. 3 is a perspective view of a scrubbing brush used with the cleaner.
Figure 4:
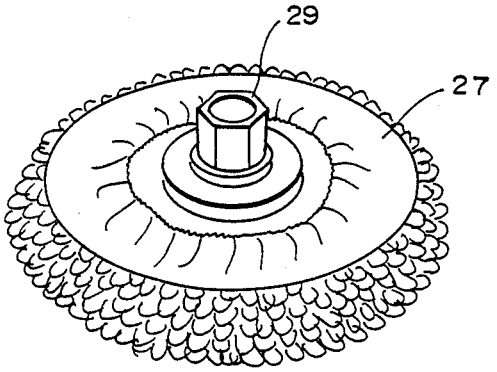
FIG. 4 is a perspective view of a floor wax polisher used with the cleaner.
Figure 5:
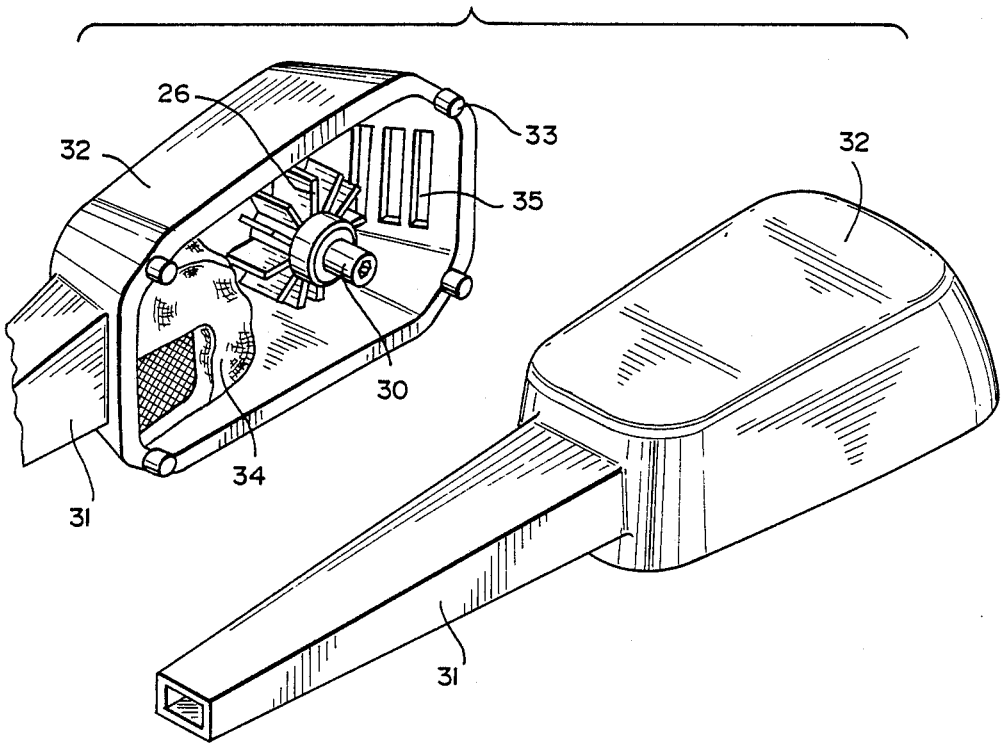
FIG. 5 is a perspective view of the dust suction device for attachment to the cleaner and depicting the outer cover, extractor vane wheel, wire net portion and extended sucker.

As shown in FIGS. 3, 4 and 5, the scrubbing brush 25, floor wax polisher 27, and air extractor vane wheel 26 are provided with respective connectors 28, 29, 30 for engagement with the revolving shafts 14, 12, 9, respectively. Such engagements can be made efficiently and correctly to provide the respective functions of scrubbing, polishing and dust suction. Further, the connector 28 of the scrubbing brush 25 has a hollow socket for receiving the conduit 16 of the revolving shaft 14 therein and permit water flow out of the conduit 16 over the circumference of the scrubbing brush 25 to facilitate the scrubbing operation.

When the air extractor vane wheel 26 is mounted on the revolving shaft 9, it is further connected with an outer cover 32 which is provided with an extended sucker 31. The outer cover 32 includes four struts 33 arranged at four corners for engagement within the four bolt holes 24 of cover plate 1. When the four struts 33 are inserted into the four bolt holes 24, the outer cover 32 is secured to the cover plate 1 at the outer side thereof. The outer cover 32 is also provided with a wire net portion 34 at the inner end of the sucker 31, and a series of exhaust holes 35 at the opposite side of the sucker 31 so that dust is caused to accumulate at the wire net portion 34 when air being sucked through the sucker 31 exhausts through the exhaust holes 35.

I claim:

1. A multi-function cleaner comprising:

(a) a housing, a driving mechanism, a cover plate and a handle;

(b) a pivotal joint connecting the handle to the housing;

(c) a water inlet at a rear end of the housing, a water outlet, and a water pipe connecting the water inlet to the water outlet;

(d) the cover plate including three holes, the driving mechanism being secured to an inner side of the cover plate and including a driving motor;

(e) three revolving shafts for rotation by the driving motor, the three revolving shafts extending through the three holes in the cover plate, and the cover plate being secured to the housing;

(f) gearing means for rotating the three revolving shafts at different speeds by the driving motor; and (g) means for connecting a first shaft to an air extractor vane wheel, means for connecting a second shaft to a floor wax polisher, and means for connecting a third shaft to a scrubbing brush to permit the cleaner to function in a dust suction, floor polishing or scrubbing operation, respectively.

2. The multi-function cleaner of claim 1 wherein the gearing means includes a plurality of driving gears of different sizes for rotating the first revolving shaft at the fastest speed, the second revolving shaft at an intermediate speed, and the third revolving shaft at the lowest speed.

3. The multi-function cleaner of claim 1 wherein the third revolving shaft includes a hollow socket, a conduit disposed at the center of the hollow socket, and the conduit including a bottom end disposed in fluid communication with the water outlet.

4. The multi-function cleaner of claim 1 further including an outer cover provided with an extended sucker, an air extractor vane wheel mounted to the outer cover, and the means for connecting the first revolving shaft to the air extractor vane wheel includes the first revolving shaft being a solid shaft and the air extractor vane wheel being provided with a hollow socket for receiving the solid shaft.

5. The multi-function cleaner of claim 4 wherein the extended sucker is disposed at a front end of the outer cover, the outer cover includes a rear end provided with a plurality of exhaust holes, a wire net portion disposed adjacent the extended sucker for removing air sucked therethrough, the cover plate includes an outer side provided with a plurality of bolt holes, the outer cover being provided with a plurality of struts, and the struts being engageable within the bolt holes for securing the outer cover to the cover plate.

* * * * *